US010980321B2

(12) United States Patent
Farmer

(10) Patent No.: US 10,980,321 B2
(45) Date of Patent: Apr. 20, 2021

(54) SHADE CANOPY

(71) Applicant: Sol Umbra, LLC, Ann Arbor, MI (US)

(72) Inventor: Roy Farmer, Ann Arbor, MI (US)

(73) Assignee: Sol Umbra, LLC, Ann Arbor, MI (US)

( * ) Notice: Subject to any disclaimer, the term of this patent is extended or adjusted under 35 U.S.C. 154(b) by 0 days.

(21) Appl. No.: 16/535,881

(22) Filed: Aug. 8, 2019

(65) Prior Publication Data

US 2021/0037933 A1 Feb. 11, 2021

(51) Int. Cl.
*A45B 25/18* (2006.01)
*A45B 15/00* (2006.01)

(52) U.S. Cl.
CPC ..... *A45B 15/00* (2013.01); *A45B 25/18* (2013.01); *A45B 2025/186* (2013.01)

(58) Field of Classification Search
CPC ..... A45B 2025/186
See application file for complete search history.

(56) References Cited

U.S. PATENT DOCUMENTS 4,154,255 A * 5/1979 Weaver ..... A45B 23/00 135/16
4,978,110 A * 12/1990 Lin ..... A45B 3/04 135/33.4
5,226,438 A * 7/1993 Dubinsky ..... A45B 25/18 135/33.2
5,368,055 A 11/1994 Johnson et al.
5,487,401 A * 1/1996 Johnson ..... A45B 25/20 135/33.41
5,601,103 A * 2/1997 Dubinsky ..... A45B 25/22 135/15.1
5,640,984 A * 6/1997 Dubunsky ..... A45B 23/00 135/15.1
7,992,582 B2 * 8/2011 Kupferman ..... A45B 25/18 135/33.2
9,549,595 B1 * 1/2017 Liu ..... A45B 19/00
9,986,799 B1 6/2018 King
2004/0211451 A1 * 10/2004 Goh ..... A45B 25/20 135/31
2005/0247334 A1 11/2005 Erickson

FOREIGN PATENT DOCUMENTS

CN 206933595 U 1/2018
KR 200472021 Y1 3/2014
KR 101963183 B1 3/2019

* cited by examiner

*Primary Examiner* — Noah Chandler Hawk
(74) *Attorney, Agent, or Firm* — Young Basile Hanlon & MacFarlane, P.C.

(57) ABSTRACT

A shade canopy, particularly a shade canopy having an upper canopy and a lower canopy, is described. The shade canopy includes an upper canopy and a lower canopy. The lower canopy includes lower canopy sections radially disposed about a central portion of the upper canopy. Each of the lower canopy sections includes opposing end portions attached to the upper canopy. Each of the lower canopy sections also includes a middle portion extending between the opposing end portions, where the middle portion hangs belong the upper canopy.

18 Claims, 6 Drawing Sheets

SHADE CANOPY

TECHNICAL, FIELD

This disclosure relates to shade canopies and, more particularly, to shade canopies having an upper canopy and a lower canopy to provide varying degrees of shade to a user.

BACKGROUND

Shade canopies, often including sheets of fabric or plastic, are commonly used to shield people and/or objects from sun. Typical applications of shade canopies include tents, patio covers, umbrellas, and the like. Many shade canopies include multiple layers to protect users from sunlight and/or precipitation. Multi-layer canopies often allow little or no sunlight through the canopy, a condition that may be undesirable to some users only wishing to avoid direct sunlight. Typical multi-layer canopies also include a separate frame structure supporting each of the canopy layers. These separate frame structures increase the weight, size, and cost of shade canopies.

SUMMARY

One aspect of this disclosure is a shade canopy comprising an upper canopy and lower canopy sections radially disposed about a central portion of the upper canopy. Each of the lower canopy sections comprises opposing end portions attached to the upper canopy. Each of the lower canopy sections also comprises a middle portion extending between the opposing end portions, where the middle portion hangs below the upper canopy.

Another aspect of this disclosure is a method of providing shade to a user. The method includes providing an upper canopy including a central portion and a first peripheral portion. The method includes providing a lower canopy including an inner peripheral portion and an outer peripheral portion. The method includes attaching the inner peripheral portion of the lower canopy to the central portion of the upper canopy. The method includes attaching the outer peripheral portion of the lower canopy to the first peripheral portion of the upper canopy. The lower canopy includes a middle portion extending between the inner peripheral portion and the outer peripheral portion. A gap is defined between the upper canopy the middle portion.

Another aspect of this disclosure is a shade canopy comprising an upper canopy having a central portion. The upper canopy includes upper canopy sections, each upper canopy, section comprising a first distal end portion distal to the central portion, a first proximate end portion proximate to the central portion, and upper canopy apertures through the upper canopy section. The upper canopy apertures are located between the first distal end portion and the first proximate end portion; The shape canopy also comprises a lower canopy including lower canopy sections, each lower canopy section comprising a second distal end portion distal to the central portion, a second proximate end portion proximate to the central portion, a middle portion extending between the second distal end portion and the second proximate end portion, and lower canopy apertures through the lower canopy section. The lower canopy apertures are located between the second distal end portion and the second proximate end portion. The first distal end portion of each upper canopy section is attached to the second distal end portion of each lower canopy section. The first proximate end portion of each upper canopy section is attached to the second proximate end portion of each lower canopy section. The middle portion of each lower canopy section hangs below a respective upper canopy section such that a gap is defined between each lower canopy section and the respective upper canopy section. The upper canopy apertures are not aligned with the lower canopy apertures.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Described herein are shade canopies including an upper canopy and a lower canopy. The upper canopy may be supported by a frame. The lower canopy may be supported by the upper canopy such that no additional frame is necessary to support the lower canopy. The upper canopy may include upper canopy apertures that may allow light through the upper canopy and onto the lower canopy. The lower canopy may include lower canopy apertures that allow light through the lower canopy. The upper canopy apertures may not align with the lower canopy apertures. In this configuration, a user can experience an optimum amount of light traveling through the upper and lower canopies.

Figure 1:
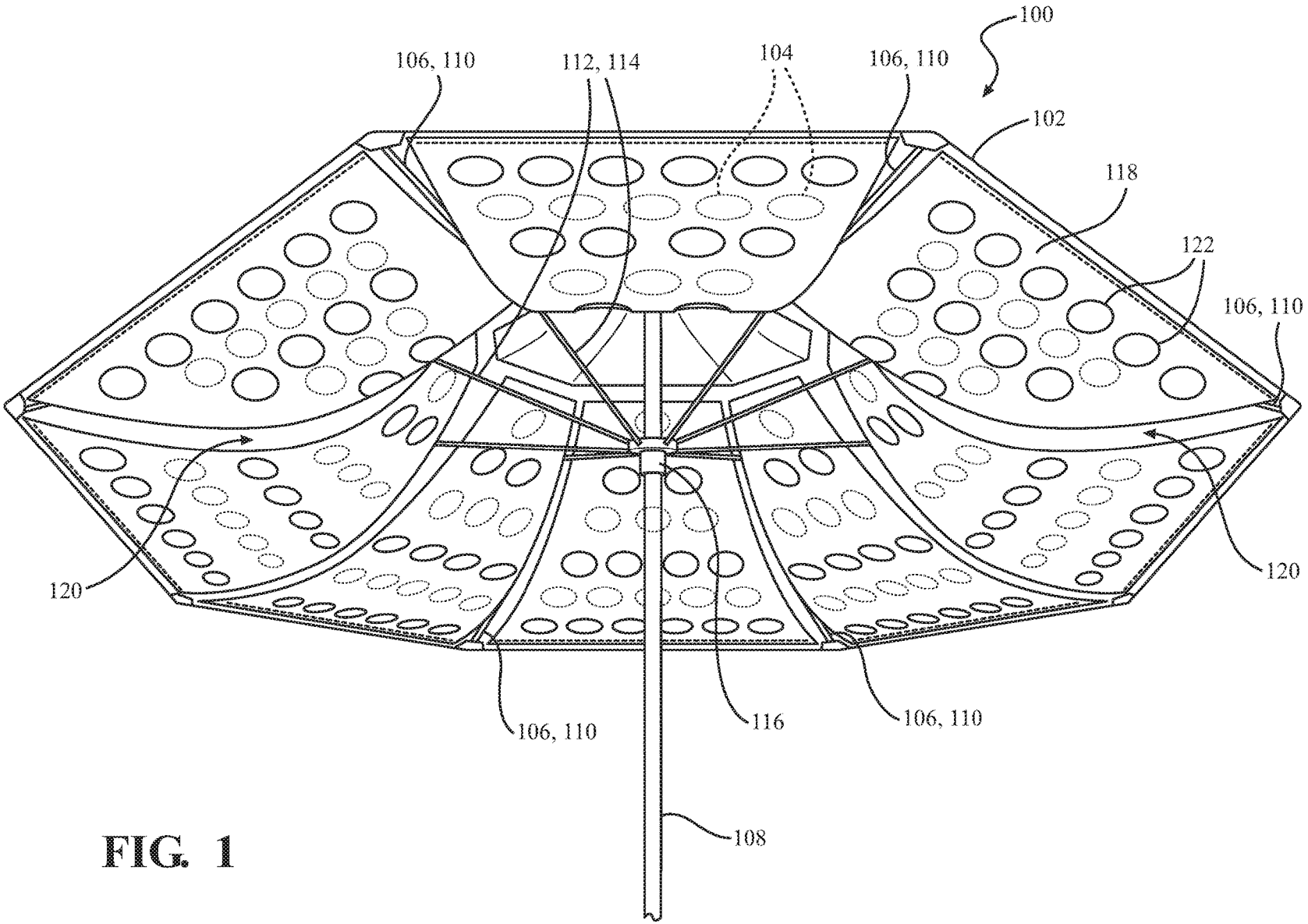
FIG. 1 is a bottom perspective view of a canopy including an upper canopy and a lower canopy.

FIG. 1 is a bottom perspective view of a canopy 100. The canopy 100 may include an upper canopy 102. The upper canopy 102 may include upper canopy apertures 104 through the upper canopy 102. The upper canopy apertures 104 are illustrated as circular but can be any other shape, such as square, triangular, star-shaped, etc. The upper canopy 102 may be supported by a first frame 106. The first frame 106 may be supported by a shaft 108. The first frame 106 may include first ribs 110 extending away from the shaft 108 in a radial direction. The first ribs 110 may be hingedly connected to the shaft 108.

To provide support for the first frame 106, the canopy 100 may include a second frame 112 extending from the first frame 106 to the shaft 108. The second frame 112 may include second ribs 114 attached at one end to the first ribs 110 of the first frame 106, The second ribs 114 may be attached at an opposing end to the shaft 108 via a coupling 116. The second ribs 114 may be hingedly connected to the first ribs 110 and/or the coupling 116. The coupling 116 may be selectively locked to the shaft 108. When the coupling 116 is not locked to the shaft 108, the coupling 116 may be moved up and down the shaft 108, The coupling 116 may be moved down the shaft 108 such that the second frame 112 moves the first frame 106 and the upper canopy 102 into a folded or collapsed position. The coupling 116 may be moved up the shaft 108 such that the second frame 112 moves the first frame 106 and the upper canopy 102 into an unfolded or open position. In other embodiments, the first frame 106, the second frame 112, and/or the coupling 116 may include additional structures or omit features that do not affect the spirit of this disclosure.

The canopy 100 may include a lower canopy 118 supported by the upper canopy 102, A portion of the lower canopy 118 may hang below the upper canopy 102 such that a gap 120 is defined between the upper canopy 102 and the lower canopy 118. The lower canopy 118 may include lower canopy apertures 122. The lower canopy apertures 122 are illustrated as circular but can be any shape, such as square, triangular, star-shaped, etc. The upper canopy apertures 104 may not align with the lower canopy apertures 122 when the first frame 106 is in the unfolded position so that the lower canopy apertures 122 are offset from the upper canopy apertures 104.

Figure 2:
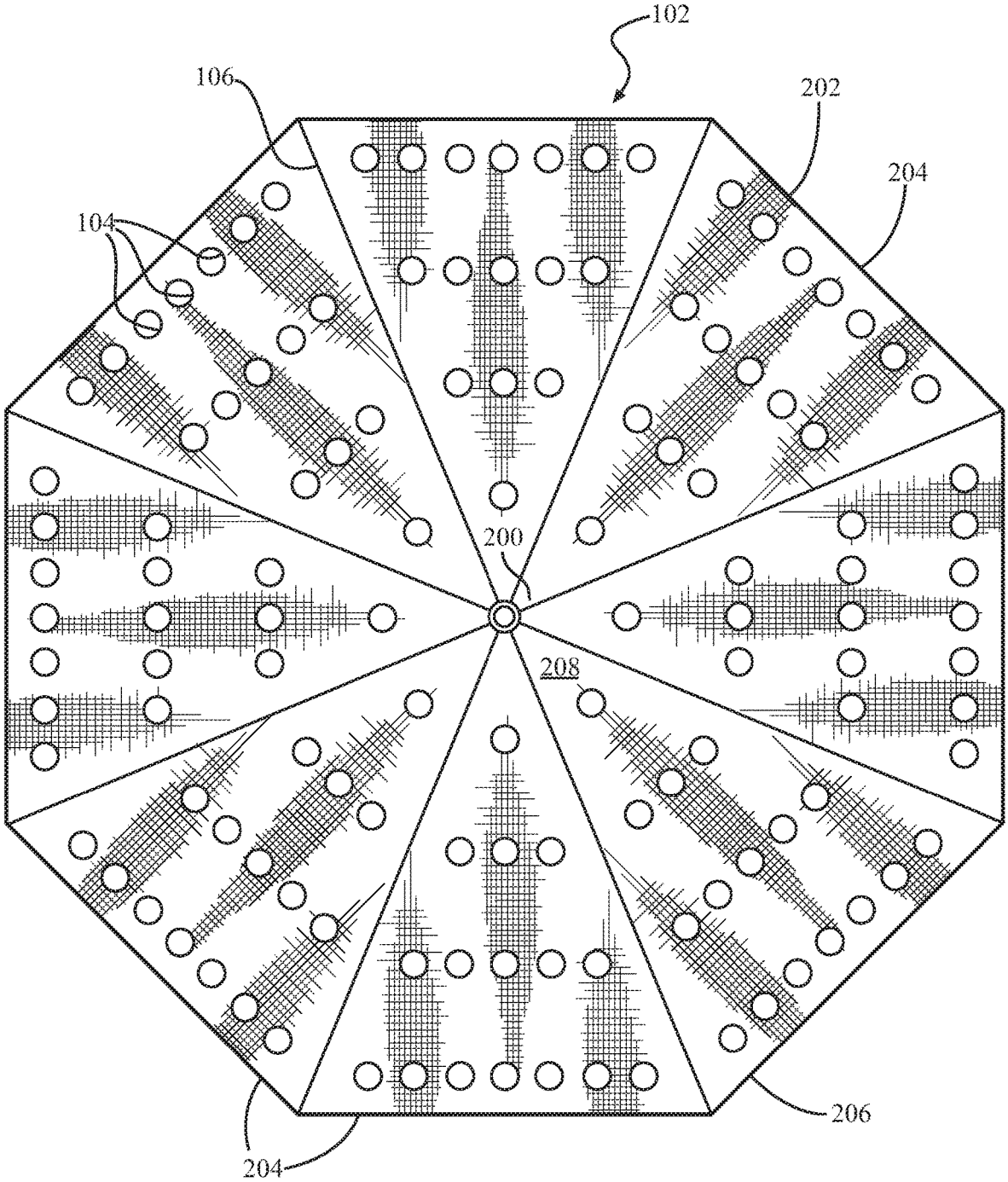
FIG. 2 is a top view of the upper canopy.

FIG. 2 is a top view of the upper canopy 102 according to one embodiment. The upper canopy 102 can include a central portion 200, which may include a portion of the upper canopy 102 surrounding the center of the upper canopy 102. The upper canopy 102 may also include a first peripheral portion 202, which may include a portion of the upper canopy 102 extending around a periphery of the upper canopy 102. The upper canopy apertures 104 may be positioned on the upper canopy 102 between the central portion 200 and the first peripheral portion 202. The upper canopy 102 may include a single sheet or separate sheets supported by the first frame 106. The upper canopy 102 may be made of any suitable material, such as fabric or plastic. The upper canopy 102 may be semi-transparent or translucent to allow some light to pass through the upper canopy 102. The upper canopy 102, including the upper canopy apertures 104, may also be attached to and/or covered in a transparent film or material that may be waterproof.

The upper canopy 102 may include upper canopy sections 204 radially disposed about the central portion 200. Each of the upper canopy sections 204 may include a separate sheet or panel extending between two of the first ribs 110 of the first frame 106 with each of the upper canopy sections 204 connected to one another. In the illustrated, non-limiting example, each of the upper canopy sections 204 have a substantially triangular shape and include a first distal end portion 206 distal to the central portion 200 and a first proximate end portion 208 proximate to the central portion 200.

In FIG. 2, each of the upper canopy sections 204 includes some of the upper canopy apertures 104. In other embodiments, the upper canopy apertures 104 may extend through one or more of the upper canopy sections 204 with some or all of the upper canopy sections 204 not having any upper canopy apertures 104. The upper canopy apertures 104 may be positioned in a first pattern on one or more of the upper canopy sections 204. For example, the upper canopy apertures 104 shown in FIG. 2 are positioned in substantially parallel rows on each of the upper canopy sections 204. In other embodiments, the first pattern may include another pattern or other patterns of apertures or no pattern at all with the location of the upper canopy apertures 104 being random. In other embodiments, different upper canopy sections 204 may have different patterns of upper canopy apertures 104.

Figure 3:
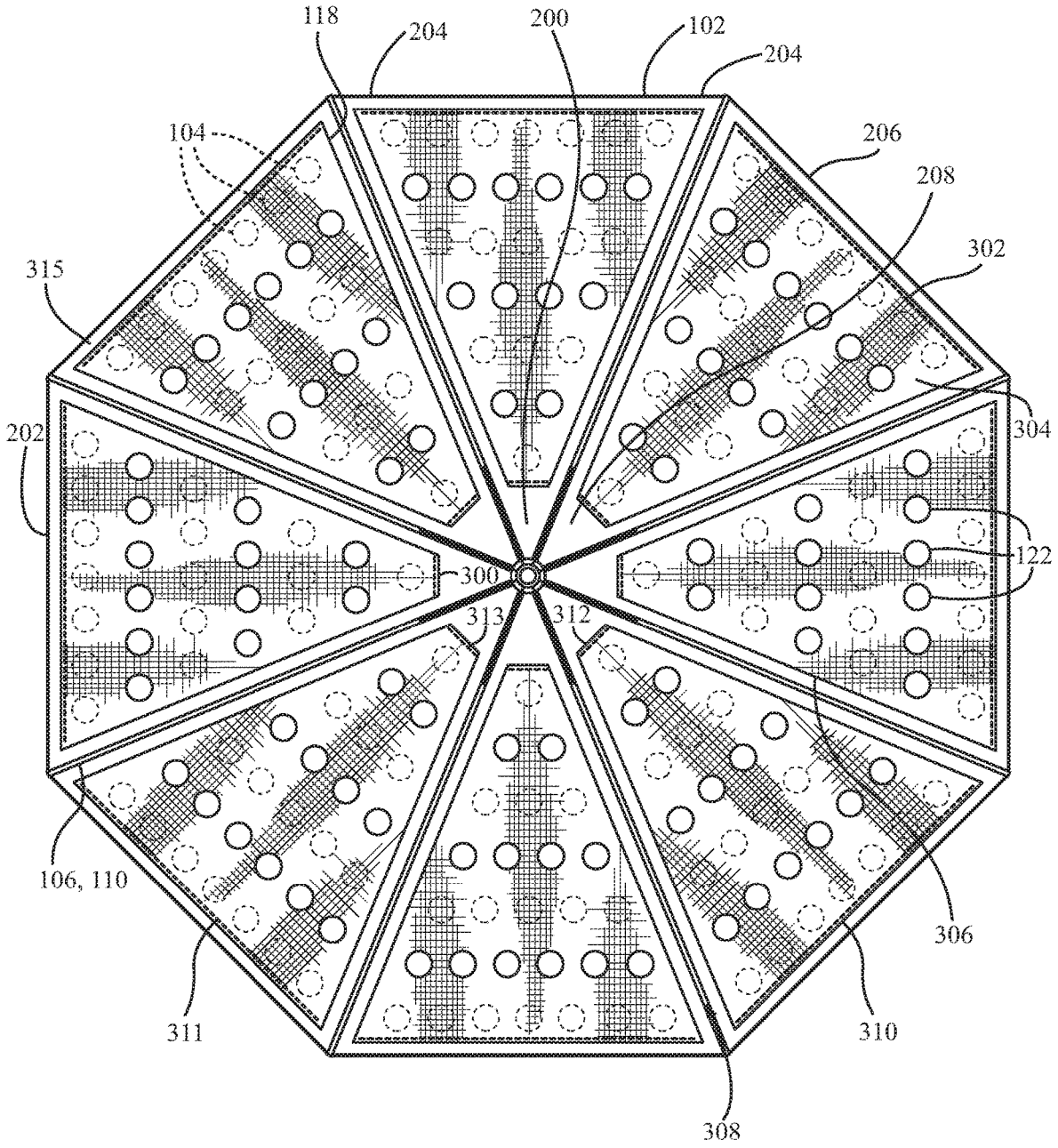
FIG. 3 is a bottom view of the lower canopy attached to the upper canopy.
Figure 4:
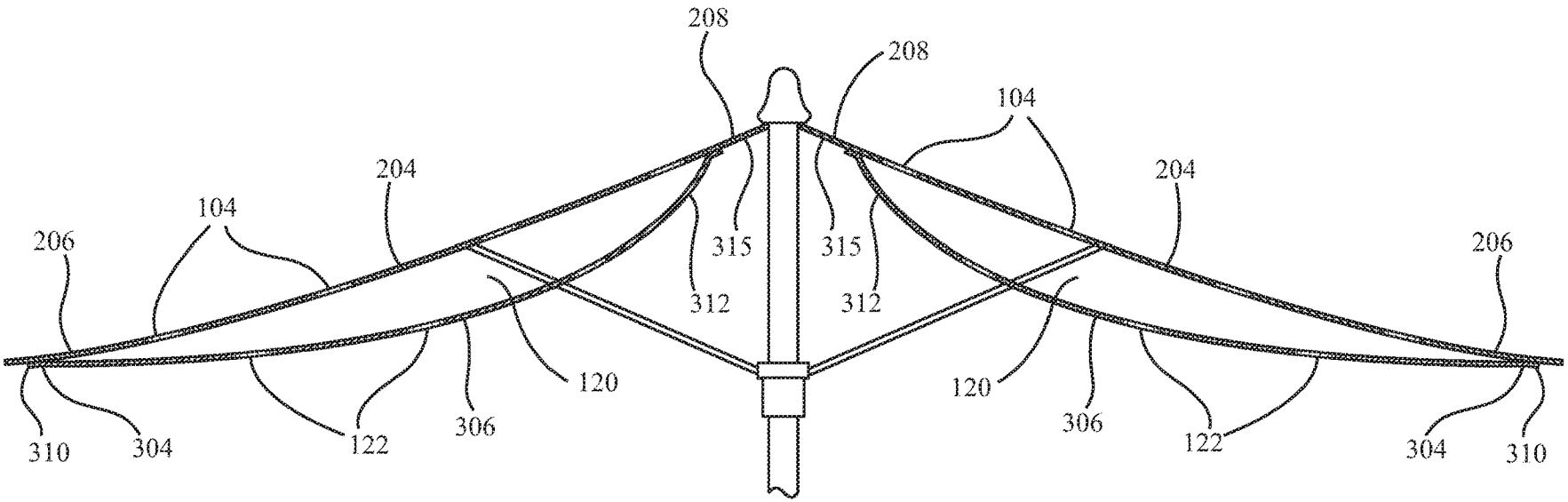
FIG. 4 is a cross sectional view of the canopy shown in FIGS. 1-3.

FIG. 3 is a bottom view of the lower canopy 118 attached to the upper canopy 102, and FIG. 4 is a cross-sectional view of the canopy 100 shown in FIGS. 1-3. The lower canopy 118 can include an inner peripheral portion 300, which may include a portion of the lower canopy 118 surrounding a center of the lower canopy 118. The lower canopy 118 may also include an outer peripheral portion 302, which may include a portion of the lower canopy 118 extending around a periphery of the lower canopy 118. The inner peripheral portion 300 may be attached to the central portion 200 of the upper canopy 102. The outer peripheral portion 302 may be attached to the first peripheral portion 202 of the upper canopy 102. The lower canopy 118 can be sewn to the upper canopy 102. Alternatively, other means of attachment can be used. In yet other embodiments, the lower canopy 118 may be attached to the first frame 106. The lower canopy 118 may include a single sheet or separate sheets supported by the upper canopy 102 and may be made of any suitable material, such as fabric or plastic. The lower canopy 118 may be semi-transparent or translucent to allow some light to pass through the lower canopy 118. The lower canopy 118 may also be attached to and/or covered in a transparent film or material that may be waterproof.

In the non-limiting example illustrated in FIG. 3, the lower canopy 118 includes lower canopy sections 304 radially disposed about the central portion 200 of the upper canopy 102. The lower canopy sections 304 may have a substantially triangular or trapezoidal shape but could have another shape. Each of the upper canopy sections 204 may be aligned with a respective lower canopy section 304. For example, each of the upper canopy sections 204 and lower canopy sections 304 may extend between two first ribs 110 of the first frame 106. In other embodiments, the lower canopy sections 304 may extend along only a portion of the length and/or width of the corresponding upper canopy section 204. When the lower canopy sections 304 are smaller than the corresponding upper canopy sections 204, a space 308 can be defined between adjacent lower canopy sections 304.

Each of the lower canopy sections 304 can include opposing ends attached to an underside of the upper canopy 102. For example, second distal end portions 310 of the lower canopy sections 304 can be attached (e.g., sewn at seams 311) to the first peripheral portion 202 of the upper canopy 102, and second proximate end portions 312 of the lower canopy sections 304 can be attached (e.g., sewn at seams 313) to the central portion 200 of the upper canopy 102. Each of the lower canopy sections 304 may or may not be attached to the respective upper canopy section 204 along lateral sides of the lower canopy section 304.

As illustrated, the second distal end portions 310 of the lower canopy sections 304 have a first width, and the second proximate end portions 312 of the lower canopy sections 304 have a second width that is less than the first width. A length of the lower canopy section 304 may be greater than a length of the upper canopy section 204. For example, the length of the lower canopy section 304 may be 15-75% greater than the length of the upper canopy section 204. Each of the lower canopy sections 304 may include a middle portion 306 extending between the second distal end portions 310 and the second proximate end portions 312. The middle portion 306 may extend away from or hang below the upper canopy 102 to define the gap 120 (FIG. 1 &. 4) formed between the middle portion 306 of the lower canopy section 304 and the upper canopy 102. The size of the gap 120 may vary depending on the implementation, which can vary the shape of the middle portion 306. For example, the middle portion 306 can have a substantially or generally arcuate configuration when the gap 120 is large, and the middle portion 306 may be generally or substantially parallel to the underside 315 of the upper canopy 102 when the gap 120 is small.

Each of the lower canopy sections 304 includes some of the lower canopy apertures 122. In other embodiments, the lower canopy apertures 122 may extend through one or more of the lower canopy sections 304. Some or all of the lower canopy sections 304 may not have any lower canopy apertures 122. The lower canopy apertures 122 may be positioned in a second pattern on one or more of the lower canopy sections 304. For example, the lower canopy apertures 122 shown in FIG. 3 are positioned in substantially parallel rows on each of the lower canopy sections 304. In other embodiments, the second pattern may include another pattern or other patterns of apertures or no pattern at all with the location of the lower canopy apertures 122 being random. In yet other embodiments, different lower canopy sections 304 may have different patterns of lower canopy apertures 122.

Figure 5A:
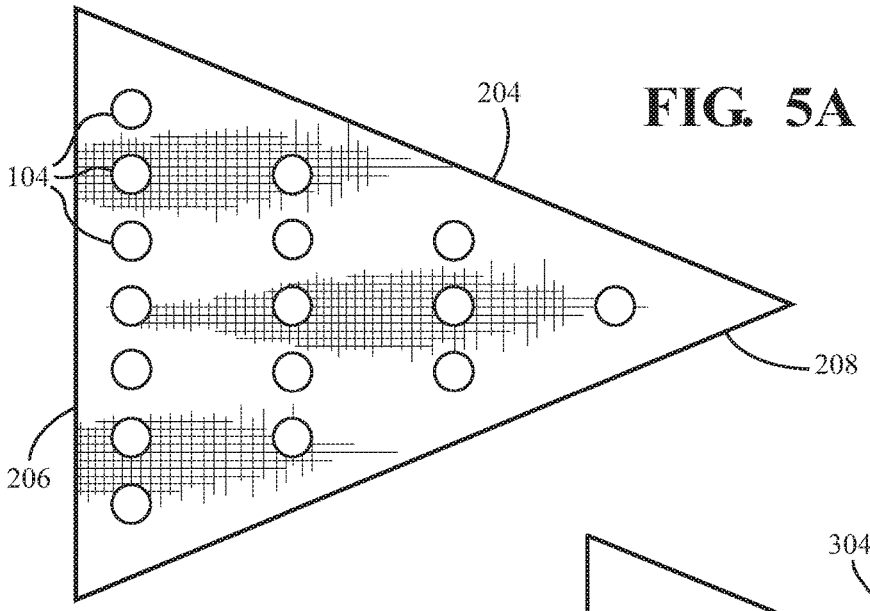
FIG. 5A is a top view of an upper canopy section of the upper canopy.
Figure 5B:
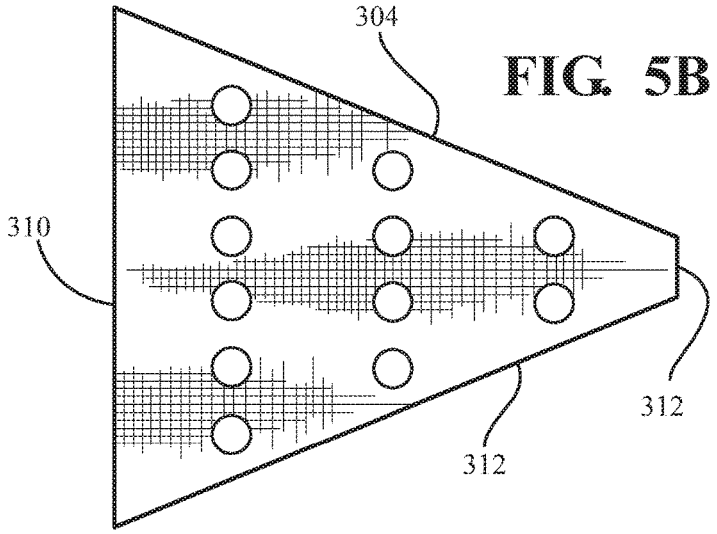
FIG. 5B is a top view of a lower canopy section of the lower canopy.
Figure 5C:
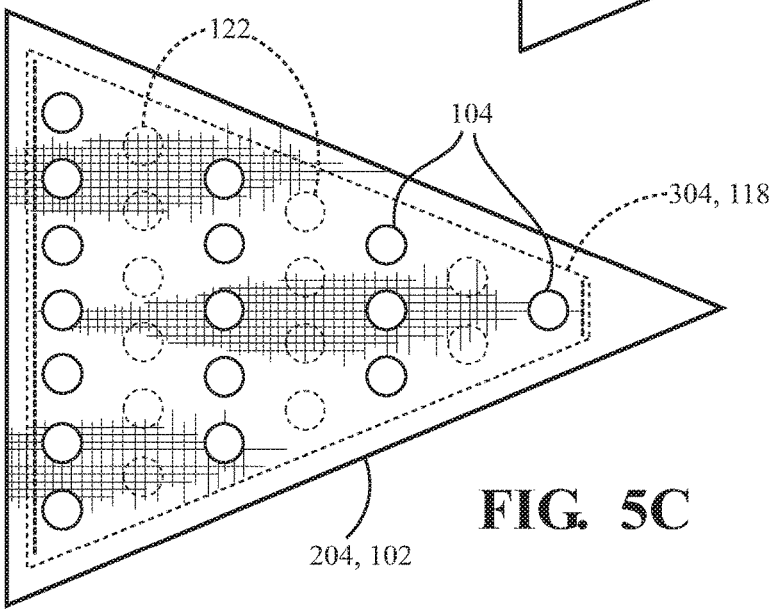
FIG. 5C is a top view of the lower canopy section attached to an underside of the upper canopy section.

FIG. 5A is a top view of the upper canopy section 204. FIG. 5B is a top view of the lower canopy section 304. FIG. 5C is a top view of the lower canopy section 304 (shown in dashed lines) attached to the underside of the upper canopy section 204. When the lower canopy section 304 is attached to the upper canopy section 204, the upper canopy apertures 104 are not aligned with the lower canopy apertures 122. As a result, varying degrees of light pass through the canopy 100 depending on the light's path thru the canopy 100.

Figure 6:
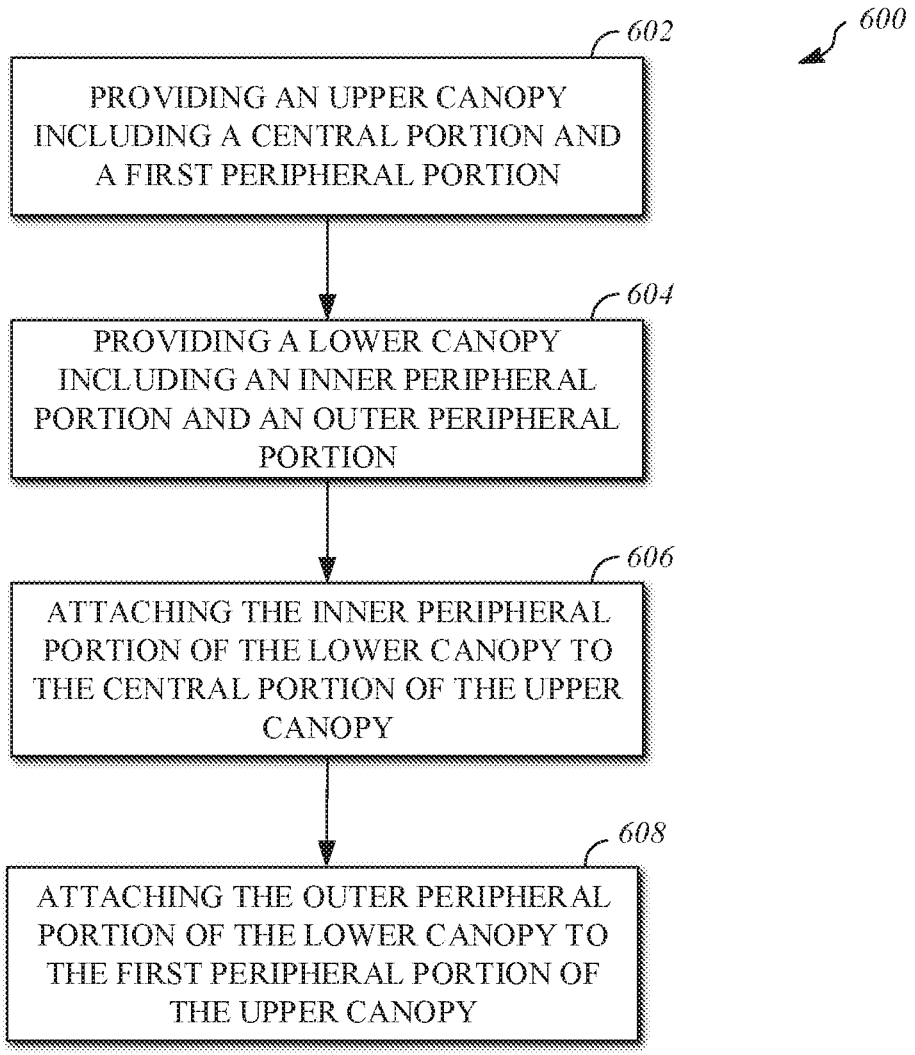
FIG. 6 is a flow diagram of a process of providing shade to a user.

FIG. 6 is a flow diagram of a process 600 of providing shade to a user. Operation 602 includes providing the upper canopy 102. Operation 604 includes providing the lower canopy 118. Operation 606 includes attaching the inner peripheral portion 300 of the lower canopy 118 to the central portion 200 of the upper canopy 102. Operation 608 includes attaching the outer peripheral portion 302 of the lower canopy 118 to the first peripheral portion 202 of the upper canopy 102. Attaching the inner peripheral portion 300 of the lower canopy 118 to the central portion 200 of the upper canopy 102 may include attaching the second proximate end portion 312 of each lower canopy section 304 to the first proximate end portion 208 of a respective upper canopy section 204. Attaching the outer peripheral portion 302 to the first peripheral portion 202 may include attaching the second distal end portion 310 to the first distal end portion 206 of the respective upper canopy section 204. Attaching the second proximate end portion 312 of each lower canopy section 304 to the first proximate end portion 208 of the respective upper canopy section 204 may include sewing the second proximate end portion 312 to the first proximate end portion 208 along the seam 313 extending along the width of the second proximate end portion 312. Attaching the second distal end portion 310 to the first distal end portion 206 of the respective upper canopy section 204 may include sewing the second distal end portion 310 to the first distal end portion 206 using the seam 311 extending along the width of the second distal end portion 310.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A shade canopy comprising:

lower canopy sections radially disposed around a central portion and having opposing ends attached to opposing ends of corresponding upper canopy sections, wherein the upper canopy sections are contiguous, wherein gaps are defined between the lower canopy sections, and wherein the opposing end portions are attached directly to undersides of the upper canopy sections.

2. The shade canopy of claim 1, wherein the gaps are defined between each of the lower canopy sections.

3. The shade canopy of claim 1, wherein an arcuate shape of the lower canopy sections is opposite an arcuate shape of the upper canopy sections.

4. The shade canopy of claim 1, wherein a radial length of the lower canopy sections is greater than or equal to a radial length of the upper canopy sections.

5. A shade canopy comprising:

an upper canopy;

lower canopy sections suspended below the upper canopy with opposing end portions of lower canopy sections attached to upper canopy and a middle portion extending between the opposing end portions, wherein the lower canopy sections are radially disposed around a central portion of the upper canopy, wherein a radial length of at least one of the lower canopy sections is greater than a radial length of the upper canopy; and at least one of:

gaps defined between the lower canopy sections;

the opposing end portions of the lower canopy sections being directly attached to an underside of the upper canopy; or an outer periphery of the lower canopy sections adjacent to at least a majority of an outermost periphery of the upper canopy with the middle portions of the lower canopy sections having an arcuate shape opposite an arcuate shape of the upper canopy and hanging below the upper canopy.

6. The shade canopy of claim 5, wherein the upper canopy includes upper canopy sections radially disposed about the central portion, wherein the upper canopy sections are aligned with a respective lower canopy section.

7. The shade canopy of claim 6, wherein:

each of the upper canopy sections includes a first distal end portion distal to the central portion and a first proximate end portion proximate to the central portion;

the opposing end portions of the lower canopy sections include a second distal end portion distal to the central portion and a second proximate end portion proximate the central portion;

the second distal end portion of each lower canopy section is attached to the first distal end portion of a respective upper canopy section; and the second proximate end portion of each lower canopy section is attached to the first proximate end portion of the respective upper canopy section.

8. The shade canopy of claim 7, wherein the second distal end portion includes a first width and the second proximate end portion includes a second width, and wherein the first width is greater than the second width.

9. The shade canopy of claim 7, wherein the second distal end portion of each lower canopy section is attached to the second distal end portion of the respective upper canopy section along a seam extending along a width of the lower canopy section, and wherein the second proximate end portion of each lower canopy section is attached to the first proximate end portion of the respective upper canopy section along a seam extending along a width of the lower canopy section.

10. The shade canopy of claim 5, comprising:

upper canopy apertures through the upper canopy; and lower canopy apertures through the lower canopy sections, wherein the upper canopy apertures do not align with the lower canopy apertures.

11. The shade canopy of claim 10, wherein the upper canopy apertures are arranged in rows, wherein the lower canopy apertures are arranged in rows, and wherein the rows of the upper canopy apertures are alternately spaced with respect to the rows of the lower canopy apertures.

12. A method of providing shade to a user, comprising:

providing an upper canopy including a central portion and a first peripheral portion;

providing a lower canopy including an inner peripheral portion, an outer peripheral portion, and a middle portion between the inner peripheral portion and the outer peripheral portion;

attaching the inner peripheral portion of the lower canopy to the central portion of the upper canopy; and attaching the outer peripheral portion of the lower canopy to the first peripheral portion of the upper canopy, wherein a radial length of the lower canopy is greater than a radial length of the upper canopy, and at least one of:

gaps defined between lower canopy sections of the lower canopy, a majority of an outermost periphery of the upper canopy being adjacent to a majority of an outermost periphery of the lower canopy with the middle portions of the lower canopy sections having an arcuate shape opposite an arcuate shape of the upper canopy and hanging below the upper canopy, or the inner peripheral portion and the outer peripheral portion of the lower canopy being attached directly to an underside of the upper canopy.

13. The method of claim 12, wherein:

the upper canopy includes upper canopy sections each having a first distal end portion distal to the central portion and a first proximate end portion proximate to the central portion;

the lower canopy includes lower canopy sections each having a second distal end portion distal to the central portion of the upper canopy and a second proximate end portion proximate to the central portion;

attaching the inner peripheral portion to the central portion includes attaching the second proximate end portion of each lower canopy section to the first proximate end portion of each upper canopy section; and attaching the outer peripheral portion to the first peripheral portion includes attaching the second distal end portion of each lower canopy section to the first distal end portion of each upper canopy section.

14. The method of claim 13, wherein:

attaching the second distal end portion of each lower canopy section to the first distal end portion of each upper canopy section includes sewing the second distal end portion to the first distal end portion using a seam extending along a width of the second distal end portion; and attaching the second proximate end portion to the first proximate end portion of each upper canopy section includes sewing the second proximate end portion to the first proximate end first portion of each upper canopy section using a seam extending along a width of the second proximate end portion.

15. The method of claim 12, a middle portion of the lower canopy has an arcuate shape.

16. The method of claim 15, wherein a space is defined between the upper canopy and the middle portion of the lower canopy.

17. The method of claim 12, wherein the upper canopy has apertures extending therethrough that are arranged in rows and the lower canopy has apertures extending therethrough that are arranged in rows, and wherein the rows of the apertures in the upper canopy are alternately spaced with respect to the rows of the apertures in the lower canopy.

18. A method of providing shade to a user, comprising:

providing an upper canopy including a central portion and a first peripheral portion;

providing lower canopy sections having inner peripheral portions and outer peripheral portions;

attaching the inner peripheral portions of the lower canopy sections to the central portion of the upper canopy, wherein the inner peripheral portion and the outer peripheral portion are attached directly to an underside of the upper canopy; and attaching the outer peripheral portions of the lower canopy sections to the first peripheral portion of the upper canopy adjacent to an outermost periphery of the upper canopy, wherein gaps are defined between each of the lower canopy sections.

* * * * *